US007815846B2

(12) United States Patent
Takahashi

(10) Patent No.: US 7,815,846 B2
(45) Date of Patent: Oct. 19, 2010

(54) AGITATOR AND MELTING FURNACE WITH AGITATOR

(76) Inventor: Kenzo Takahashi, 149, Rokkodai 9-Chome, Matsudo-Shi, Chiba-Ken (JP)

( * ) Notice: Subject to any disclaimer, the term of this patent is extended or adjusted under 35 U.S.C. 154(b) by 619 days.

(21) Appl. No.: 11/170,442

(22) Filed: Jun. 30, 2005

(65) Prior Publication Data

US 2006/0001200 A1 Jan. 5, 2006

(30) Foreign Application Priority Data

Jun. 30, 2004 (JP) ..... 2004-193875

(51) Int. Cl.
*F27D 27/00* (2010.01)
*B01F 13/08* (2006.01)
*H05B 6/34* (2006.01)

(52) U.S. Cl. ..... 266/233; 266/234; 266/235; 266/237; 366/273; 366/274; 373/85; 373/107; 373/116; 373/146

(58) Field of Classification Search ..... 266/233–235, 266/237; 373/85, 116, 146, 107; 366/273–274
See application file for complete search history.

(56) References Cited

U.S. PATENT DOCUMENTS

| | | | | |
|---|---|---|---|---|
| 2,573,319 A | | 10/1951 | Dreyfus et al. | |
| 2,686,823 A | | 8/1954 | Jones | |
| 2,711,436 A | * | 6/1955 | Jones et al. | 373/146 |
| 3,334,993 A | * | 8/1967 | Nojima | 75/565 |
| 5,385,338 A | * | 1/1995 | Sato et al. | 266/234 |
| 5,810,907 A | * | 9/1998 | Okada et al. | 75/687 |

FOREIGN PATENT DOCUMENTS

| | | | |
|---|---|---|---|
| JP | 51-28530 | | 10/1976 |
| JP | 04-329819 | * | 11/1992 |
| JP | 05-156378 | | 6/1993 |
| JP | 10146650 | | 2/1998 |
| JP | 10-146650 | * | 6/1998 |
| JP | 11-287563 | | 10/1999 |

* cited by examiner

*Primary Examiner*—Roy King
*Assistant Examiner*—Lois Zheng
(74) *Attorney, Agent, or Firm*—Winston & Strawn LLP

(57) ABSTRACT

An agitator for applying an alternating field to a melting furnace main body in order to melt a row material to form a melt includes a plurality of magnets, which are arranged so that magnetic lines of force emitted from one of the magnets pass through the melt in the melting furnace main body and return to another magnet, the magnets being fixed to an inclined surface which is inclined by an angle with respect to a horizontal surface, and being rotatable around an axis substantially perpendicular to the inclined surface.

19 Claims, 4 Drawing Sheets

AGITATOR AND MELTING FURNACE WITH AGITATOR

CROSS-REFERENCE TO RELATED APPLICATION

This application is based upon and claims the benefit of priority from prior Japanese Patent Application No. 2004-193875, filed on Jun. 30, 2004, the entire contents of which are incorporated herein by reference.

BACKGROUND OF THE INVENTION

1. Field of the Invention

The present invention relates to an agitator and a melting furnace with an agitator.

2. Background Art

Conventionally, among melting furnaces for melting, for example, aluminum for the purpose of recycling, aluminum melting furnaces with agitators can be classified into those of a mechanical type, which insert a rotational body into a furnace in order to directly agitate aluminum, those of a low-pressure type, which use a negative pressure pump to suck up melt to agitate it, and those of an electromagnetic type which generate a shifting magnetic field by causing a three-phase alternating current to flow through a fixed electrode and electromagnetically agitate aluminum based on the generated magnetic field.

The aforementioned mechanical-type furnaces do not have a sufficient durability since the rotational body is used to directly agitate a high-temperature melt. Furthermore, there is a problem in that the operation and the maintenance thereof are complicated. Low-pressure type furnaces are not widely used since the operability thereof is not so good. Electromagnetic-type furnaces require a high current, thereby increasing power consumption, resulting in high running costs. Furthermore, since the cooling of coils thereof requires great care, the cost of the entire equipment is inevitably increased, which hinders the widespread use thereof.

SUMMARY OF THE INVENTION

The present invention is proposed in consideration of the aforementioned current situation, and it is an object of the present invention to propose an agitator and a melting furnace which are not expensive, have good operability, can operate with a low running cost, and can surely melt an inputted material.

A melting furnace with agitator according to a first aspect of the present invention includes:

a melting furnace main body for melting a raw material to make a melt; and an agitator for applying an alternating field to the melt in the melting furnace main body to agitate the melt, the agitator including a plurality of magnets which are arranged so that magnetic lines of force emitted from one of the magnets pass through the melt in the melting furnace main body and return to another magnet, the magnets being fixed to an inclined surface which is inclined by an angle with respect to a horizontal surface, and being rotatable around an axis substantially perpendicular to the inclined surface.

An agitator for applying an alternating field to a melt in a melting furnace main body according to a second aspect of the present invention includes a plurality of magnets, which are arranged so that magnetic lines of force emitted from one of the magnets pass through the melt in the melting furnace main body and return to another magnet, the magnets being fixed to an inclined surface which is inclined by an angle with respect to a horizontal surface, and being rotatable around an axis substantially perpendicular to the inclined surface.

DESCRIPTION OF THE EMBODIMENTS

Figure 1:
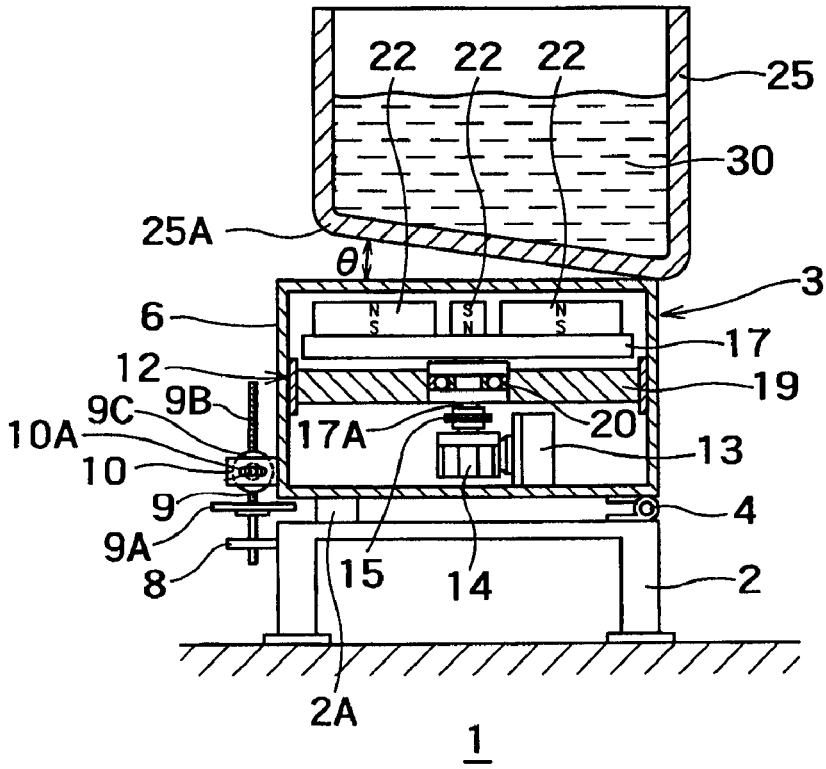
FIG. 1(*a*) is a vertically sectioned explanatory drawing of an embodiment of the present invention, and FIGS. 1(*b*) and 1(*c*) are enlarged views of a part thereof.
Figure 1:
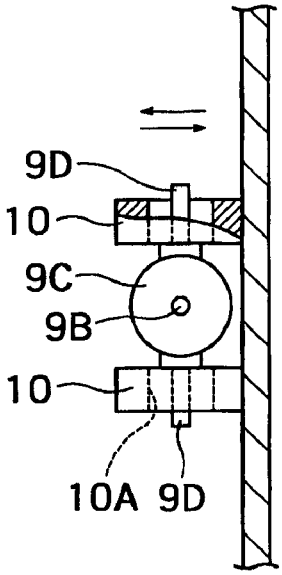
Figure 1:
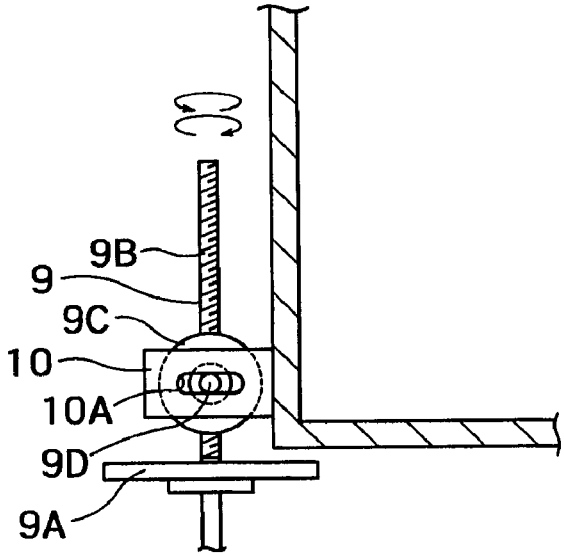
Figure 2:
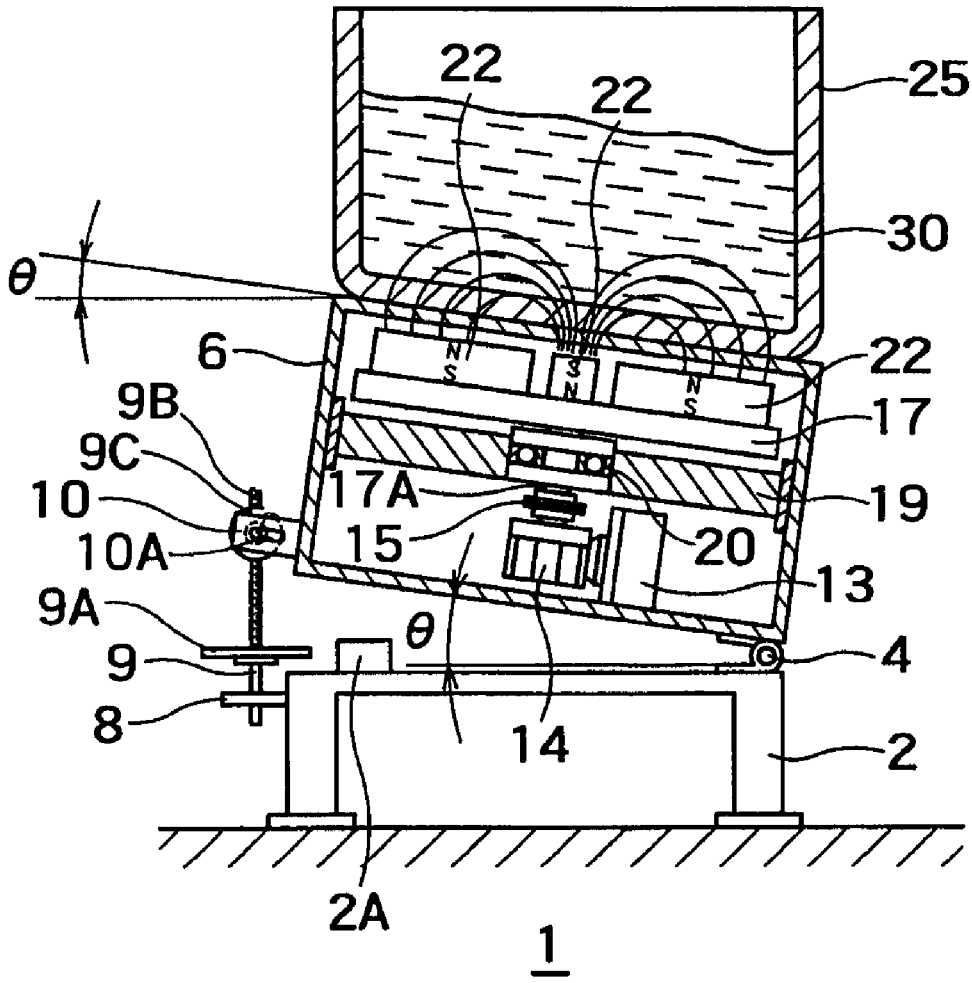
FIG. 2 is a vertically sectioned explanatory drawing showing the operation state of FIG. 1.

FIG. 1(*a*) shows an embodiment of the present invention in a non-use state, and FIG. 2 shows it in a use state. FIGS. 1(*b*) and 1(*c*) are drawings obtained by enlarging a part of FIG. 1(*a*). FIG. 1(*b*) is a plan view viewing part of the apparatus of FIG. 1(*a*) from above, and FIG. 1(*c*) is a view viewing the part from the same direction as FIG. 1(*a*). In FIG. 1(*a*), a frame 2 is fixed on a floor 1. A magnetic field generating portion 3 is mounted on the frame 2 in such a manner that it is rotatable around a hinge 4, i.e., around a substantially horizontal axis extending in a direction perpendicular to the surface of the drawing paper, so as to be capable of moving up and down. That is to say, the magnetic field generating portion 3 has a hollow housing (support base) 6, which is mounted on the frame 2 so as to be capable of rotating to move up and down around the hinge 4, i.e., around a substantially horizontal axis, as can be understood from FIG. 1(*a*) and FIG. 2. Actually, the moving up and down operations are performed around the substantially horizontal axis of the hinge 4 by lifting up the left side of the housing 6 shown in FIG. 1 so as to move it away from a support member 2A of the frame 2, and pulling it down to the original position. Various kinds of mechanisms can be employed to perform such an operation. In the shown embodiment, a screw mechanism is employed. Of course, a gear mechanism can also be employed. In FIG. 1(*a*), a driving rod 9 is supported by a support portion 8 fixed to the frame 2 so as to be capable of rotating around an axis (substantially vertical axis) thereof. In particular, as can be understood from FIG. 1(*c*), a handle (wheel type handle) for driving rotation 9A is fixed to a substantially central portion in the longitudinal direction of the driving rod 9. The upper portion of the driving rod 9 is threaded to form a so-called male screw portion 9B. The male screw portion 9B is screwed into a substantially ball-shaped female screw body 9C. Due to the rotations of the male screw portion 9B, the female screw body 9C is moved up and down. In particular, as can be understood from FIG. 1(*b*), members to be driven 10, 10 fixed to the housing 6 are supported by the female screw body 9C in a mutually rotatable manner by lateral axes 9D, 9D. Furthermore, as can be understood from FIG. 1(*c*), slits 10A, 10A are formed in the members to be driven 10, 10 in a longitudinal direction, so that they are mutually slidable with respect to the axes 9D, 9D. With such a structure, when the driving rod 9 is rotated with the handle 9A, the female screw body 9C is moved up and down, thereby moving the members to be driven 10, 10 so that the members to be driven 10, 10 are rotated around the axes 9D, 9D and the axes 9D, 9D are slid inside the slits 10A, 10A, resulting in that the magnetic field generating portion 3 is lifted up, as shown in, for example, FIG. 2. That is to say, the housing 6 is rotated around the hinge 4 so as to move up and down. It is possible to control the degree of movement of the housing 6 by adjusting the degree of rotation of the handle 9A. The mechanism for moving the housing 6 up and down is not limited to the aforementioned one.

Figure 3:
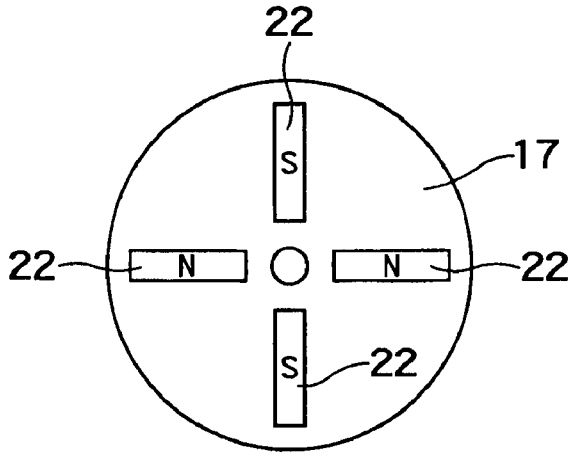
FIGS. 3(*a*) and 3(*b*) are a plan view and a side view, respectively, showing an example of an arrangement of the permanent magnets shown in FIG. 1.
Figure 3:
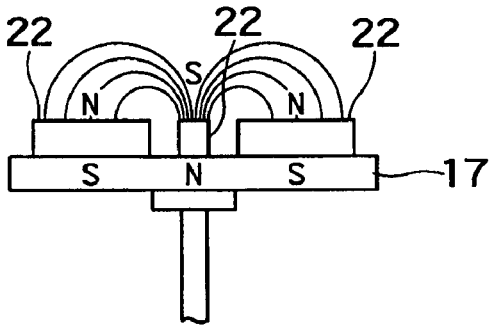
Figure 4:
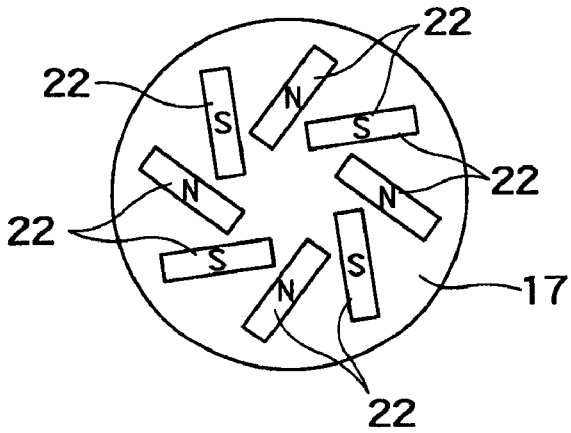
FIG. 4 is a plan view showing another example of an arrangement of the permanent magnets.

A magnetic field generating device (agitator) 12 is provided within the housing 6. The magnetic field generating device (agitator) 12 has a mounting base 13 fixed on the inner bottom of the housing 6. A driving motor 14, the rotation speed of which can be continuously changed, is fixed to the mounting base 13. An axis of the driving motor 14 is connected to an axis 17A of a magnet base (turntable) 17 via a coupling 15. The axis 17A is supported by a bearing 20 located at a central portion of a stay 19, both ends of which are fixed to the inner walls of the housing 6. As can be particularly understood from FIGS. 3(*a*) and 3(*b*), rod-shaped permanent magnets 22, 22 . . . are fixed on the magnet base 17. Each permanent magnet 22 has magnetic poles on both upper and lower surfaces. The permanent magnets 22, 22 . . . are arranged in a manner that the magnetic poles of the upper surfaces of two adjacent permanent magnets differ from each other. The two adjacent permanent magnets form a magnet pair. In this case, two magnet pairs are provided. As shown in FIG. 4, the permanent magnets 22, 22 . . . can be arranged so that four magnet pairs are provided. With such a structure, the rotations of the driving motor 14 are conveyed to the magnet pairs, i.e., the permanent magnets 22, 22 . . . via the coupling 15 and the magnet base 17.

A melting furnace (melting furnace main body) 25 of a non-magnetic material is provided above the housing 6 (magnetic field generating portion 3) and fixed by a mechanism not shown. As can be understood from FIG. 1(*a*), a bottom portion 25A of the melting furnace 25 is inclined by an angle θ. In this manner, as can be understood from FIG. 2, the bottom portion 25A contacts the upper surface of the housing 6 when the housing 6 (magnetic field generating portion 3) is lifted around the hinge 4 so that the magnetic lines of force can be used as effectively as possible.

In order to use the apparatus shown in FIGS. 1(*a*) to 2, the housing 6 (magnetic field generating portion 3) in the state of FIG. 1(*a*) is lifted around the hinge 4 to be brought into the state of FIG. 2. In the state of FIG. 2, the magnetic lines of force of each of the permanent magnets 22, 22 . . . pass through the melt 30, e.g., melted aluminum, as shown in FIG. 2.

In the state of FIG. 2, initially, aluminum in the melting furnace 25 is melted by a burner or the like, not shown, to make the melt 30. When aluminum scrap is put into the melt in this state and the permanent magnets 22, 22 . . . are rotated by the motor 14, the magnetic lines of force emitted from the permanent magnets 22, 22 . . . move to pass through the melt 30. That is to say, an alternating field is applied to the melt 30. Accordingly, an eddy current is generated, and the melt 30 starts being rotated around an axis substantially perpendicular to the magnet base 17, i.e., in an inclined state in the melting furnace 25. That is to say, the surface of the melt 30 is rotated in a state substantially parallel to the surface of the magnet base 17 (the upper surface of the lifted permanent magnets 22). Thus, in this apparatus, the permanent magnet 22 is rotated in a state of being inclined by an angle θ, as described above. In a case where it is held in a horizontal state (θ=0°), the melt 30 is rotated with its central portion being concaved. In such a case, the melt 30 is rotated to create an undisturbed flow. In this state, it is not possible to melt aluminum with great efficiency. In contrast, in this embodiment, the permanent magnets 22 are included by an angle θ. Accordingly, as shown in FIG. 2, the melt 30 is rotated in a state where the liquid surface thereof is inclined by the magnetic lines of force. Therefore, the flow of the melt 30 becomes irregular and vigorous. Because of such a flow, when a raw material (aluminum scrap etc.) is put into the melt 30, the raw material does not float on the melt 30, but is efficiently mixed into the melt 30, thereby surely being melted in a short time.

In order to effectively perform such an agitation operation, it is desirable that the strength of the permanent magnets 22 be set so that the magnetic field strength at the inner bottom portion of the melting furnace 25 is 0.2-0.3 T or more. Furthermore, it is desirable that the rotation speed of the permanent magnets 22 (magnet pairs), i.e., the magnet base 17, be 60-250 rpm when there are two magnet pairs of permanent magnets 22, as shown in FIG. 3. That is to say, the rotation speed should be changed in accordance with the number of permanent magnets 22, 22 . . . provided on the magnet base 17, i.e., the number of two adjacent permanent magnets 22, 22 (magnet pairs) having different magnetic poles. It is desirable that when there are two magnet pairs as shown in FIG. 3, the rotation speed should be about 60-250 rpm; when there are four pairs as shown in FIG. 4, the rotation speed should be about 30-125 rpm; and when there are eight pairs, the rotation speed should be about 15-62.5 rpm. That is to say, it is desirable that when there are n magnet pairs, the rotation speed should be about (120/n)-(500/n) rpm. The meaning of the rotation speed is as follows. A cycle of 1 Hz is defined as a cycle in which only one pair of magnets passes a reference point in one second due to the rotations of the magnet base 17. It is desirable that the magnet base 17 be rotated with the rotation speed to set the cycle to about 2-8.33 Hz.

Figure 5:
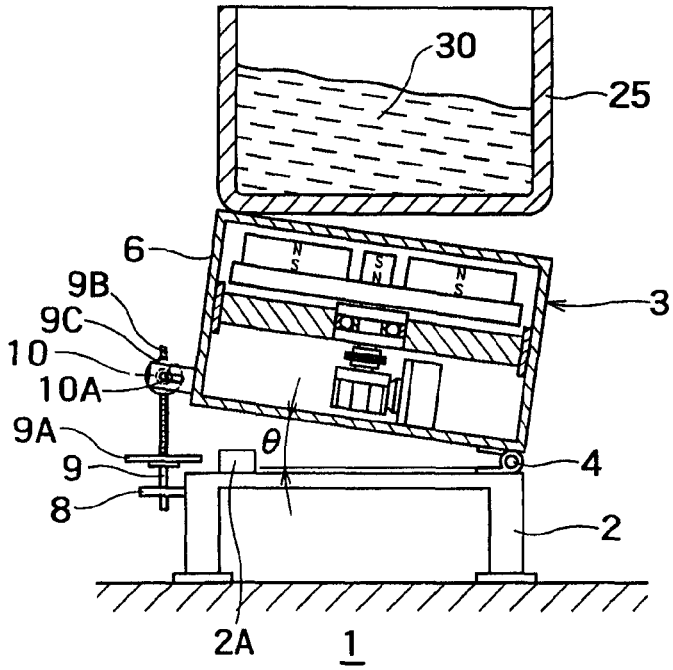
FIG. 5 is a vertically sectioned explanatory drawing showing another embodiment of the present invention.

The bottom surface of the melting furnace 25 should not necessarily be inclined by an angle θ. The melting can be performed with an angle of less than θ, or when θ=0, meaning that the bottom surface is horizontal as can be understood from FIG. 5.

Figure 6:
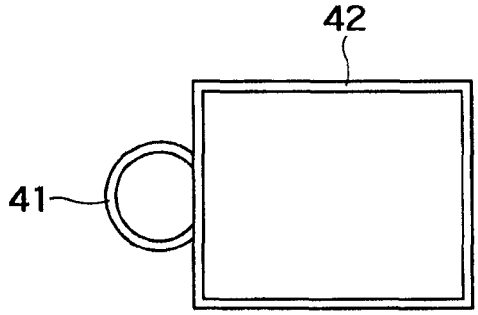
FIGS. 6(*a*) and 6(*b*) are a plan view and a vertically sectioned explanatory drawing, respectively, of an embodiment of a furnace to which the apparatus of FIG. 1 is applied.
Figure 6:
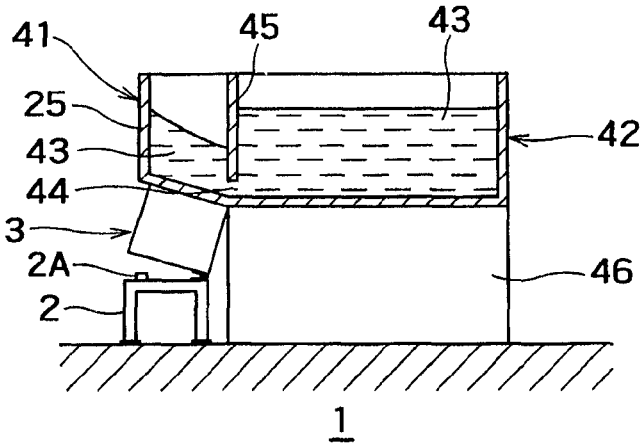

FIGS. 6(*a*) and 6(*b*) show an embodiment in which the apparatus shown in FIGS. 1(*a*) to 2 is used as an auxiliary furnace 41, and the melt obtained therein is poured into a large scale furnace 42. That is to say, the melt 43 melted in the auxiliary furnace 41 flows into the large scale furnace 42 provided above a frame 46 through a gap 44 of a partition 45 provided between the auxiliary furnace 41 and the large scale furnace 42. In FIG. 6, the elements which are the same as those used in FIGS. 1 and 2 are assigned the same reference numerals.

Thus, according to the present invention, it is possible to effectively rotate the melt in the melting furnace, thereby reliably melting the material to be put into the melt.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concepts as defined by the appended claims and their equivalents.

What is claimed is:

1. A melting furnace with agitator comprising:

a melting furnace main body for melting a raw material to make a melt; and an agitator for applying an alternating field to the melt in the melting furnace main body to agitate the melt, the agitator including a plurality of permanent magnets, each of the magnets having magnetic poles on an upper portion and a lower portion thereof, and wherein said magnets are arranged so that magnetic lines of force emitted from one of the permanent magnets pass through the melt in the melting furnace main body and return to another magnet, the magnets being fixed to the inclined surface of a rotatable turntable which is inclined by an angle with respect to a horizontal surface creating a first angle between the agitator and the bottom of the melting furnace main body and a second angle between a support base and the agitator, and being rotatable in one plane around an axis substantially perpendicular to the inclined surface; and wherein the magnetic poles of the upper portions of two permanent magnets adjacent to each other in a circumferential direction on the turntable differ from each other, said agitator provided to the support base located below the melting furnace main body and wherein the first and second angles are adjustable by lifting up or pulling down one side of the support base and rotating around a substantially horizontal axis.

2. The melting furnace with agitator according to claim 1, wherein the bottom surface of the melting furnace main body is inclined along the inclined surface of the agitator.

3. The melting furnace with agitator according to claim 1, wherein a rotation speed of the magnets is controllable.

4. The melting furnace with agitator according to claim 1, further comprising a motor for rotating the permanent magnets, a driving speed of the motor being changeable or variable.

5. The melting furnace with agitator according to claim 1, wherein the support base is a housing.

6. The melting furnace with agitator according to claim 1, wherein the support base is mounted on a frame fixed to a floor so as to be capable of rotating around the substantially horizontal axis of a hinge.

7. The melting furnace with agitator according to claim 6, further comprising a driving mechanism for lifting up or pulling down one side of the support base and rotating the support base around the substantially horizontal axis, the driving mechanism being a screw mechanism or a gear mechanism.

8. The melting furnace with agitator according to claim 7, wherein the driving mechanism is capable of moving the support base from a substantially horizontal position to a position at which an inclination of the support base is substantially parallel to an inclined bottom surface of the melting furnace.

9. The melting furnace with agitator according to claim 7, wherein the driving mechanism is capable of rotating the housing to move it up so that an upper surface of the housing contacts the inclined bottom surface of the melting furnace main body.

10. The melting furnace with agitator according to claim 1, wherein a magnetic force of the permanent magnets is from 0.2 T to 0.3 T inside the bottom surface of the melting furnace.

11. The melting furnace with agitator according to claim 1, wherein a pair of permanent magnets adjacent to each other forms a magnet pair, and when there are n permanent magnet pairs on the turntable, the turntable is rotatable with a rotation speed in a range of from 120/n to 500/n in rpm.

12. A melting furnace with agitator comprising:

the melting furnace with agitator according to claim 1; and another melting furnace connected to the melting furnace main body.

13. An agitator for applying an alternating field to a melt in a melting furnace main body comprising a plurality of permanent magnets; each of the permanent magnets having magnetic poles on an upper portion and a lower portion thereof, said magnets arranged so that magnetic lines of force emitted from one of the permanent magnets pass through the melt in the melting furnace main body and return to another permanent magnet, the magnets being fixed to the inclined surface of a rotatable turntable which is inclined with respect to a horizontal surface creating a first angle between the agitator and the bottom of the melting furnace main body and a second angle between a support base and the agitator, and being rotatable in one plane around an axis substantially perpendicular to the inclined surface; and wherein the magnetic poles of the upper portions of two permanent magnets adjacent to each other in a circumferential direction on the turntable differ from each other, the agitator being provided to the support base wherein the first and second angles are adjustable by lifting up or pulling down one side of the support base and rotating around a substantially horizontal axis.

14. The agitator according to claim 13, wherein a rotation speed of the magnets is controllable.

15. The agitator according to claim 13, further comprising a motor for rotating the magnets, a driving speed of the motor being changeable or variable.

16. The agitator according to claim 13, wherein the support base is a housing.

17. The agitator according to claim 13, wherein the support base is mounted on a frame fixed to a floor so as to be capable of rotating around the substantially horizontal axis of a hinge.

18. The agitator according to claim 17, further comprising a driving mechanism for lifting up or pulling down one side of the support base and rotating the support base around the substantially horizontal axis, the driving mechanism being a screw mechanism or a gear mechanism.

19. The agitator according to claim 18, wherein the driving mechanism is capable of moving the support base from a substantially horizontal position to a position at which an inclination of the support base is substantially parallel to an inclined bottom surface of the melting furnace.

* * * * *

UNITED STATES PATENT AND TRADEMARK OFFICE

CERTIFICATE OF CORRECTION

PATENT NO. : 7,815,846 B2
APPLICATION NO. : 11/170442
DATED : October 19, 2010
INVENTOR(S) : Takahashi It is certified that error appears in the above-identified patent and that said Letters Patent is hereby corrected as shown below:

Column 5:
Line 11, delete "by an angle".

Signed and Sealed this
Twenty-eighth Day of December, 2010

David J. Kappos

David J. Kappos
*Director of the United States Patent and Trademark Office*